US006481031B1

(12) United States Patent
Hwang

(10) Patent No.: US 6,481,031 B1
(45) Date of Patent: Nov. 19, 2002

(54) PILLOW ORIENTED FOR COMFORT IN VARYING SLEEPING POSITIONS

(76) Inventor: In Mo Hwang, 11362 Greenwood St., Fontana, CA (US) 92337

( * ) Notice: Subject to any disclaimer, the term of this patent is extended or adjusted under 35 U.S.C. 154(b) by 0 days.

(21) Appl. No.: 09/990,926

(22) Filed: Nov. 14, 2001

(51) Int. Cl.[7] ..... A47G 9/00
(52) U.S. Cl. ..... 5/636; 5/640; 5/643
(58) Field of Search ..... 5/636, 637, 640, 5/643, 645

(56) References Cited

U.S. PATENT DOCUMENTS

| | | | | | |
|---|---|---|---|---|---|
| 2,940,087 | A | * | 6/1960 | Kiefer | 5/643 X |
| 3,140,497 | A | * | 7/1964 | Carswell | 5/643 X |
| 3,141,179 | A | * | 7/1964 | McLean | 5/642 |
| 3,243,828 | A | * | 4/1966 | McCarty | 5/636 |
| 3,276,046 | A | * | 10/1966 | Capelli | 5/640 X |
| 3,366,106 | A | * | 1/1968 | Yao et al. | 606/204.35 |
| 3,795,018 | A | * | 3/1974 | Broaded | 5/613 |
| 3,828,377 | A | * | 8/1974 | Eary, Sr. | 5/643 X |
| 3,913,155 | A | * | 10/1975 | Eary, Sr. | 5/632 |
| 3,946,452 | A | * | 3/1976 | Eary, Sr. | 5/632 |
| 4,028,754 | A | * | 6/1977 | Eary, Sr. | 5/428 |
| 4,045,678 | A | * | 8/1977 | Rickard | 378/174 |
| 4,207,878 | A | * | 6/1980 | Duncan | 601/134 |
| 4,275,472 | A | * | 6/1981 | Erck | 5/618 |
| 4,321,718 | A | * | 3/1982 | Chern | 5/637 |
| 4,531,247 | A | * | 7/1985 | Eary, Sr. | 5/643 X |
| 4,771,493 | A | * | 9/1988 | Park | 5/637 |
| 4,840,362 | A | * | 6/1989 | Bremer et al. | 5/632 |
| 4,850,067 | A | * | 7/1989 | Latorre | 5/636 |
| 5,287,576 | A | * | 2/1994 | Fraser | 5/637 |
| 5,360,017 | A | * | 11/1994 | Austin | 5/640 |
| 5,410,769 | A | * | 5/1995 | Waterman | 5/643 X |
| 5,471,691 | A | * | 12/1995 | Ryndak | 5/645 |
| 5,661,862 | A | * | 9/1997 | Ryndak | 5/636 |
| 5,771,514 | A | * | 6/1998 | Wilhoit | 5/644 |
| 5,781,947 | A | * | 7/1998 | Sramek | 5/640 X |
| 5,809,597 | A | * | 9/1998 | Shaw | 5/640 X |
| 5,848,448 | A | * | 12/1998 | Boyd | 5/636 |
| 5,926,880 | A | * | 7/1999 | Sramek | 5/636 |
| 5,933,890 | A | * | 8/1999 | Codd | 5/636 |
| D416,742 | S | * | 11/1999 | Sramek | D6/601 |
| 5,987,676 | A | * | 11/1999 | Littleford et al. | 5/636 |
| 6,006,380 | A | * | 12/1999 | Sramek | 5/636 |
| 6,047,420 | A | * | 4/2000 | Priester, III et al. | 5/632 |

FOREIGN PATENT DOCUMENTS

| | | | | |
|---|---|---|---|---|
| AT | 32626 B | * | 4/1908 | 5/640 |

* cited by examiner

*Primary Examiner*—Robert G. Santos

(57) ABSTRACT

A pillow comprising an elongated base member having a left support unit, a central support unit, and a right support unit slideably mounted thereon. The central support unit, being positioned between the left and right support units, is of a lower predetermined height than the left and right support unit. Each support unit further comprises a support base of a firm material which is the portion attaching to the base member. A padding forms the top surface of each support units, and an inwardly protruding depression is formed on the top surface of the padding of each of the left and right support units.

4 Claims, 2 Drawing Sheets

Fig. 1
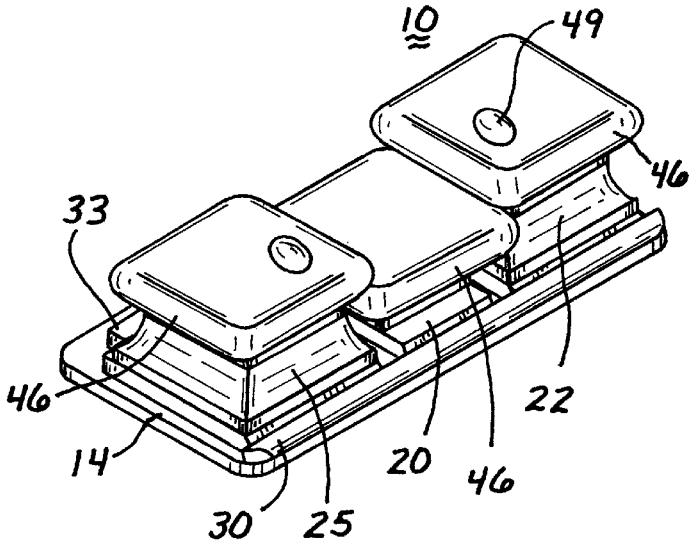
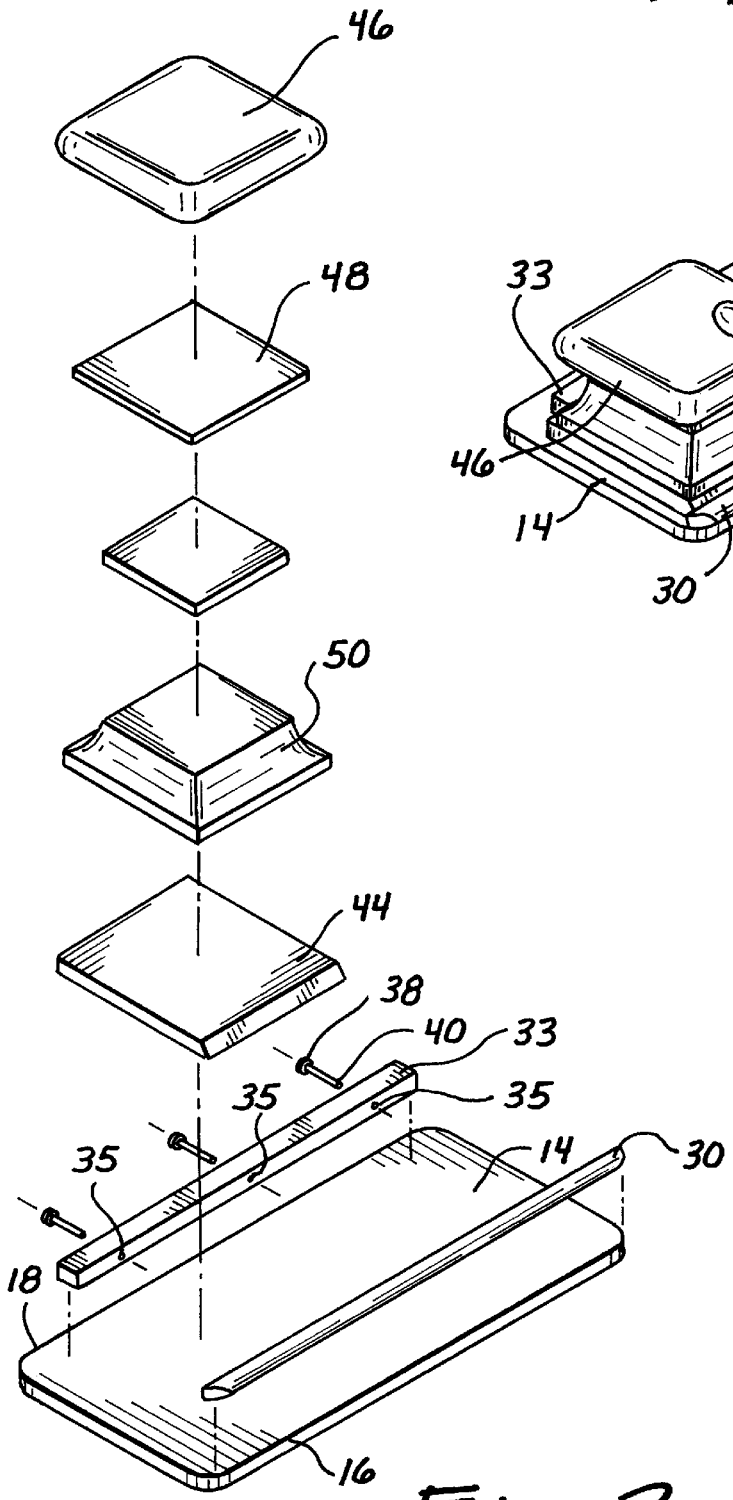
Fig. 2

Fig. 3
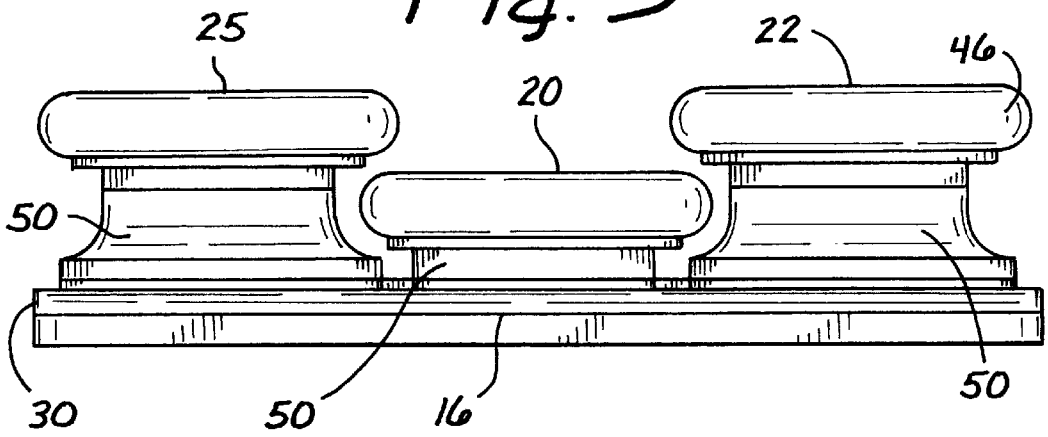
Fig. 4
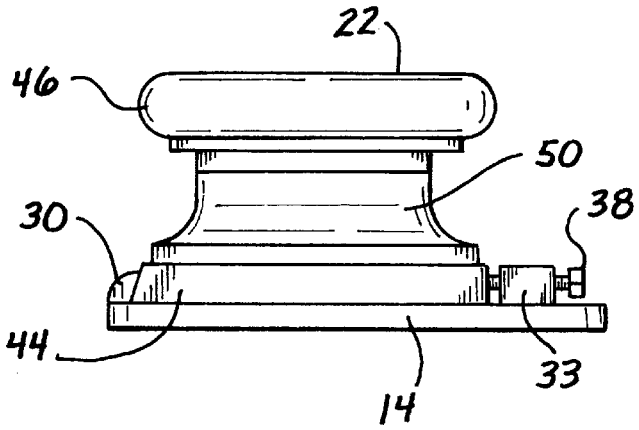
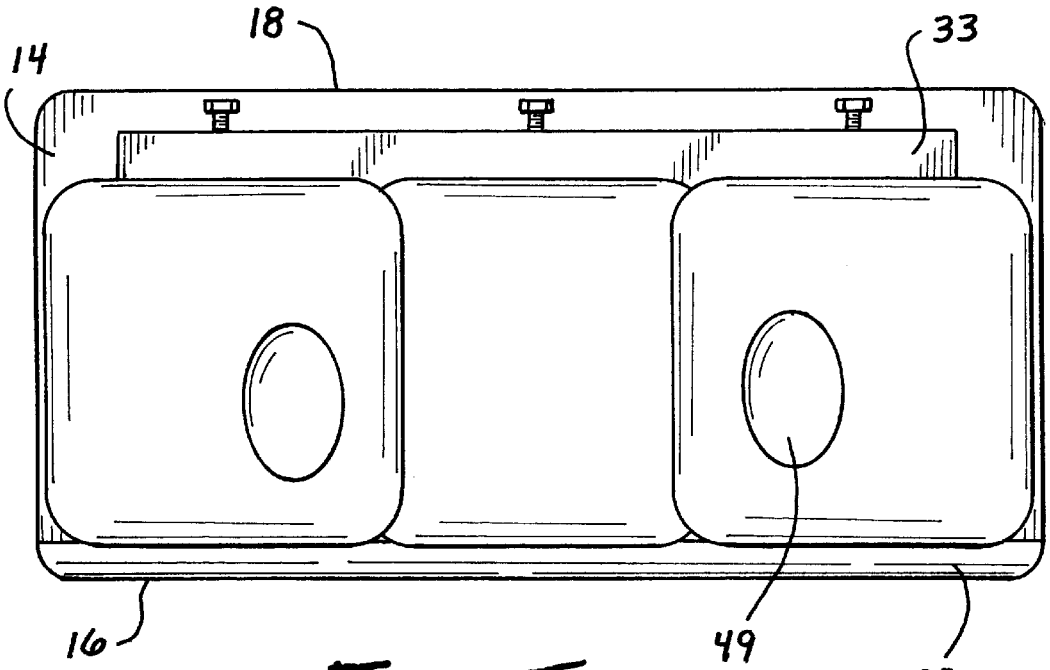
Fig. 5

PILLOW ORIENTED FOR COMFORT IN VARYING SLEEPING POSITIONS

BACKGROUND OF THE INVENTION

The present invention relates to a head-rest device for comfort in sleeping. More particularly, the present invention relates to an improved pillow for comfort in varying sleeping positions including side-rest positions.

The main purpose of a pillow is to provide comfort for the head of the user in varying sleeping positions. The main types of sleeping positions are the side-rest position in which either the left or right side of the head rests against the pillow and the head-up position in which the back of the head rests against the pillow.

A pillow most commonly comes in the form of a sac filled with a soft filling member such as feather, cotton, sponge or any other preferred soft material. The firmness of the sac varies according to the preference of the user. However, for many, these common types of pillow leave much to be desired in terms of comfort. As such, other types of pillow have been contrived to address the comfort factor lacking in the conventional pillow. One type of pillow is the contoured pillow which has a contoured portion raised above the main surface of the pillow. In the contoured pillow, the main surface provides support to the head while the contoured portion provides support to the neck. One such contoured pillow is taught in U.S. Pat. No. 5,937,460. The 5,937,460 patent teaches a pillow having a contoured based member having one or more side cushions attached to one or both sides of the base member. The side cushions are connected to the base like flaps which can be removed from or placed on top of the side portion of the base.

Another type of pillow is taught in U.S. Pat. No. 5,644,810 issued to Kato. The pillow in Kato has a pair of horizontally opposed side head supports separated by a central head back support unit. The side head supports are raised at a higher level from the central head back support unit. The central unit further has pair of vertically opposed neck support section raised from the central unit.

None of the prior art teaches the pillow as taught in the present invention.

SUMMARY OF THE INVENTION

Accordingly, it is an object of the present invention to provide a pillow offering the most comfort to an individual when sleeping in varying positions. Additionally, it is an object of the present invention to provide a comfortable pillow which can be adjusted to accommodate varying size of people's head and varying size preferences.

The present invention will now be described. The present invention is a pillow comprising an elongated base member. The pillow further has a central support unit positioned between a left support unit and a right support unit. The central support unit is of a lower predetermined height than the left and right support units. Each support unit is slideably mounted on the base member to allow adjustment of the space between the support units.

Each support unit is comprised of a support base of a firm material which is the portion attaching to the base member. A padding forms the top surface of each support unit. The height of the support unit can be varied according to the thickness of a lightweight spacer member placed between the padding and the support base.

For comfort when sleeping in the right-side or left-side position, an inwardly protruding depression is formed into the top surface of the padding of each of the left and right support units.

BRIEF DESCRIPTION OF THE DRAWINGS

These and other features, aspects and advantages of the present invention will become better understood with reference to the accompanying drawings, wherein:

FIG. 1 is a perspective view of the pillow according to the present invention;

FIG. 2 is a perspective exploded view of the pillow of the present invention;

FIG. 3 is front elevational view of the present invention;

FIG. 4 is side elevational view of the present invention; and

FIG. 5 is a top plan view of the present invention.

DETAILED DESCRIPTION OF THE PREFERRED EMBODIMENTS

With reference to the accompanying drawings, the present invention will now be described. As shown in FIGS. 1–5, the present invention is provided as a pillow 10 comprising an elongated base member 14 having a front edge 16 and a back edge 18. The pillow 10 further has a central support unit 20, a left support unit 22, and a right support unit 25. Each support unit 20, 22, 25 is slideably mounted on the base member 14. The central support unit 20 is positioned between the left 22 and right units 25.

The space between each of the left, right, and central support units 22, 25, 20 can be adjusted by laterally sliding each unit on the base member 14. An elongated front ridge 30 protrudes from and extends adjacent the front edge 16 of base member 14, and an elongated rear ridge 33 protrudes from and extends adjacent the back edge 18 of the base member 14. At least three spaced holes 35 extend through the rear ridge 33. Each of the left, right, and central support units 22, 25, 20 are slideably mounted on the base member 14 between the front 30 and rear ridge 33.

There are several ways to lock the support units 20, 22, 25 in the desired position. In one embodiment, an elongated screw having a knob 38 and a threaded elongated pin 40 protruding therefrom is utilized. The pin 40 is of a predetermined size and dimension to threadably engage through the hole 35 and press against the corresponding support unit 20, 22, 25, thereby locking the support unit in a desired position.

Each support unit 20, 22, 25 further comprises a support base 44 of a firm material. The support base 44 must be of a dense material able to withstand the pressure of the pin 40 pressing thereon when the pin 40 is locking said corresponding support unit 20, 22, 25 in the desired position. Such material can be of a dense and hard wood or even a light metal alloy. A padding 46 is formed on the top surface of each support unit 20, 22, 25. An essentially flat, rigid support plate member 48 attaches. to the bottom surface of each padding 46 to impart consistency on the form of the padding 46. A spacer member 50 formed of a lightweight foam material is placed between the plate member 48 and the support base 44 to provide a desired level of distance between the base member 14 and each padding 46.

For optimal comfort to the user, the central support unit 20 is of a lower predetermined height than the height of the left and right support units 22, 25. When sleeping in the "head up position" (wherein the head faces straight upward), the back portion of the user's head should rest on the padding 46 of the central support unit 20. When sleeping in the "left-side position" (wherein the head faces to the user's left), the left side of the user's head should rest on the padding 46 of the left support unit 22. When sleeping in the "right-side position" (wherein the head faces to the user's right), the right side of the user's head should rest on the padding 46 of the right support unit 25.

For comfort when sleeping in the right-side or left-side position, each of the left and right support units has a depression 49 formed inwardly into the top surface of the padding 46. The size and position of the depression 49 corresponds to the position of the user's ear when the corresponding side of the user's head rests thereon, and the size of the depression 46 prevents squeezing of the ear when the corresponding side of the user's head rests thereon.

Although the invention has been described in considerable detail with reference to certain preferred versions thereof, other versions are possible by converting the aforementioned construction. Therefore, the scope of the invention shall not be limited by the specification specified above and the appended claims.

What is claimed is:

1. A pillow comprising;

an elongated base member having a front edge and a back edge;

an elongated front ridge protruding from and extending adjacent said front edge of said base member;

an elongated rear ridge protruding from and extending adjacent said back edge of said base member;

a least three spaced holes extending through said rear ridge;

a central support unit, a left support unit, and a right support unit mounted on said base member, said central support unit being disposed between said left and right support units;

each support unit further comprising:

a support base attaching to said base member;

a padding formed on the top surface of each support unit; wherein said central support unit is of a lower predetermined height than said height of said left and right support units;

each of said left, right, and central support units being slideably mounted on said base member between said front and rear ridge so that the space between each of said left, right, and central support units can be adjusted by laterally sliding said units on said base member;

at least three elongated screws, each screw having a knob and a threaded elongated pin protruding therefrom, each pin being of a predetermined size and dimension to threadably engage through said holes and press against said corresponding support base, thereby locking said support base in a desired position.

2. A pillow as described in claim 1 wherein each of said left and right support units comprises a depression formed inwardly into the top surface of the padding.

3. A pillow comprising;

an elongated base member having a front edge and a back edge;

an elongated front ridge protruding from and extending adjacent said front edge of said base member;

an elongated rear ridge protruding from and extending adjacent said back edge of said base member;

at least three spaced holes extending through said rear ridge;

a central support unit, a left support unit, and a right support unit disposed on said base member, said central unit being disposed between said left and right units;

each support unit further comprising:

a support base of a firm material, said support base being the portion of each said support unit disposed on said base member;

a padding formed on the top surface of each support unit;

an essentially flat, rigid support plate member attached to the bottom surface of each padding;

a spacer member formed of a lightweight foam material disposed between said plate member and said support base;

wherein said central support unit is of a lower predetermined height than said height of said left and right support units;

wherein said left, right, and central support units are slideably mounted on said base member between said front and rear ridge so that the space between each of said left, right, and central support units can be adjusted by laterally sliding said support units on said base member;

an elongated screw corresponding to each hole formed on said rear ridge, each screw having a knob and a threaded elongated pin protruding therefrom; said pin being of a predetermined size and dimension to threadably engage through said corresponding hole and press against said corresponding support base, thereby locking said support base in a desired position.

4. A pillow as described in claim 3 wherein each of said left and right support units comprises a depression formed inwardly into the top surface of the padding.

* * * * *